US011744345B2

(12) United States Patent
Williams

(10) Patent No.: US 11,744,345 B2
(45) Date of Patent: Sep. 5, 2023

(54) MULTI AXIS ALIGNMENT TINES FOR A HAIR COMB

(71) Applicant: Bruce Preston Williams, Grosse Pointe Park, MI (US)

(72) Inventor: Bruce Preston Williams, Grosse Pointe Park, MI (US)

(73) Assignee: Bruce Preston Williams, Grosse Pointe Park, MI (US)

( * ) Notice: Subject to any disclaimer, the term of this patent is extended or adjusted under 35 U.S.C. 154(b) by 497 days.

(21) Appl. No.: 16/826,387

(22) Filed: Mar. 23, 2020

(65) Prior Publication Data

US 2021/0289910 A1 Sep. 23, 2021

(51) Int. Cl.
*A45D 24/02* (2006.01)

(52) U.S. Cl.
CPC ..... *A45D 24/02* (2013.01)

(58) Field of Classification Search
CPC ... A45D 2/42; A45D 2/44; A45D 8/12; A45D 8/30; A45D 24/00; A45D 24/02; A45D 24/04; A45D 24/06; A45D 24/30; A45D 24/42
USPC ..... D28/13, 19, 21, 22, 23, 24, 25, 27, 28, D28/29, 30, 31, 32, 33, 34, 44, 45, 49, D28/50, 51, 52, 53, 54, 63, 74
See application file for complete search history.

(56) References Cited

U.S. PATENT DOCUMENTS

| | | | | |
|---|---|---|---|---|
| 2,984,248 | A * | 5/1961 | Sidelman | A45D 8/12 132/158 |
| 3,575,183 | A * | 4/1971 | Tanner, Sr. | A45D 24/02 D28/21 |
| 4,026,307 | A * | 5/1977 | Morrow | A45D 24/00 132/148 |
| 8,342,188 | B2 * | 1/2013 | Pabari | A45D 24/30 132/142 |
| 10,194,738 | B2 * | 2/2019 | Steiner | A46B 9/023 |
| D868,372 | S * | 11/2019 | Robbins | D28/30 |
| 2016/0367009 | A1 * | 12/2016 | Cacciabaudo | A01K 13/002 |

* cited by examiner

*Primary Examiner* — Cris L. Rodriguez
*Assistant Examiner* — Karim Asqiriba
(74) *Attorney, Agent, or Firm* — CALDWELL INTELLECTUAL PROPERTY LAW

(57) ABSTRACT

A hair comb with improvements in the design of the individual comb tines that result in a more thorough alignment of the individual hair strands when the comb is used on the hair. A comb that uses the individual tines to align the individual hair strands in a primary and a secondary manner. A hair comb with tines that have more than one alignment function. A hair comb with appropriately spaced tines that can aid in the removal of unwanted debris in the hair.

10 Claims, 7 Drawing Sheets

FIG. 3A
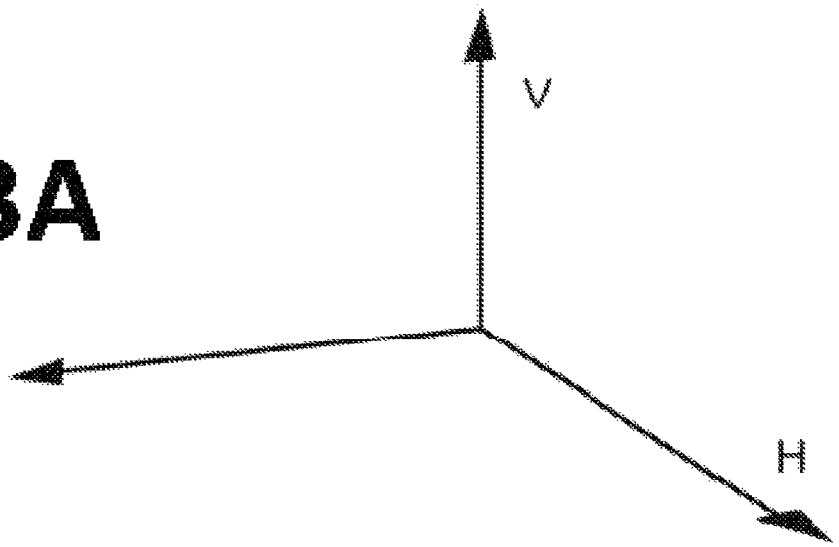
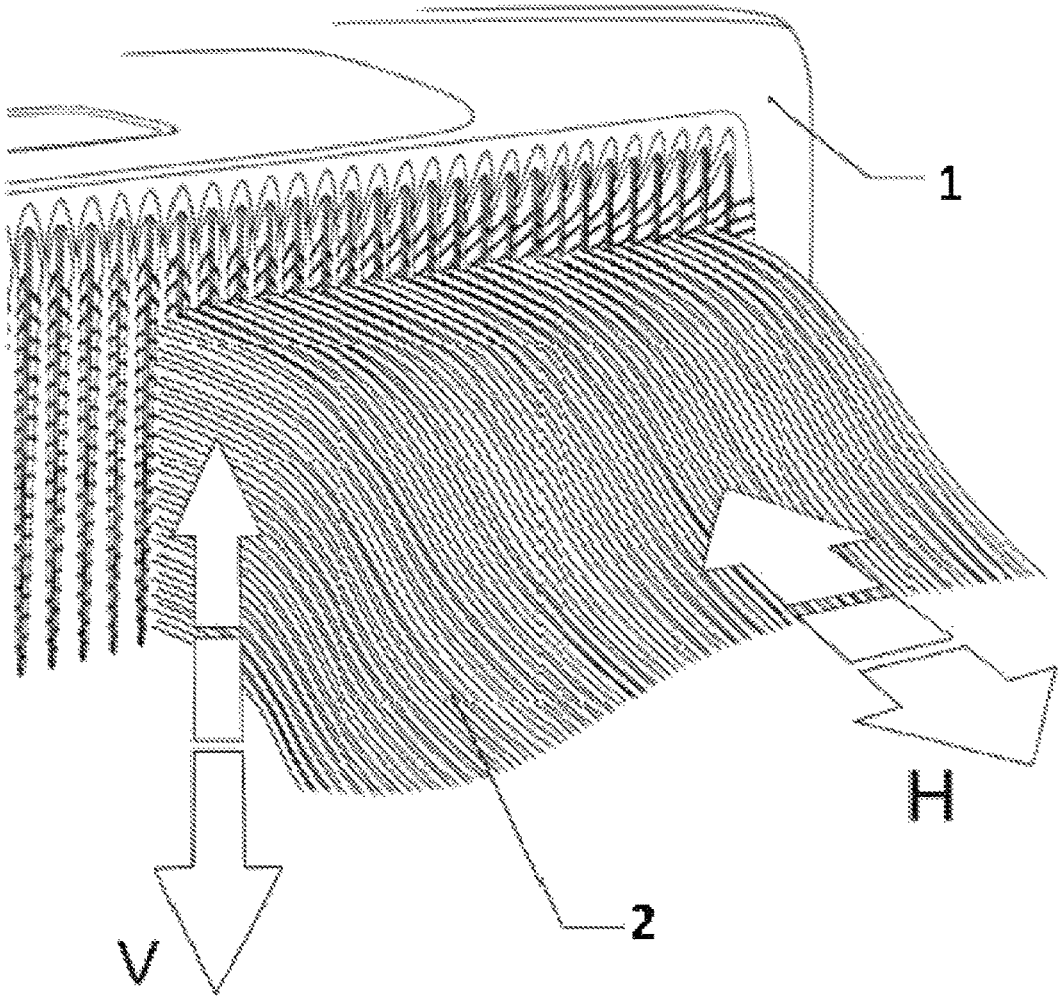
FIG. 3B

1C

2C

MULTI AXIS ALIGNMENT TINES FOR A HAIR COMB

RELATED APPLICATION

This application claims priority to U.S. provisional patent application No. 62/823,860 entitled "Multi Axis Alignment Tines for a Hair Comb" filed Mar. 26, 2019, the contents of which provisional application are incorporated herein by reference in their entirety.

BACKGROUND

Hair combs have existed for a significant amount time in recorded history, and have served the function of grooming and aligning the hair. Conventional hair combs typically include as part of their design a singular line, or array, of 'tines'. These 'tines' can be further described as the individual teeth of a hair comb and provide the main function in the comb for aligning and grooming the hair. The number of teeth, or tines can vary within each unique comb design, along with the size and spacing of the tines themselves. The comb, with it's array of tines, serves to align the hair when the comb is passed/dragged through the hair. The tines of the comb—on conventional comb designs—align the hair in a specific and singular manner when used to groom the hair. This is due to the positioning of the individual tines, as well as the individual tine shape. Accordingly, there is a need for an individual hair comb tine design that can align and groom the hair in a more detailed, descriptive and organized manner than existing hair comb tines when incorporated on various hair comb designs.

BRIEF DESCRIPTION OF THE DRAWINGS

FIGS. 3A, 3B show images that describe a hair comb with an array of comb tines that are oriented in a specific manner when combing hair. The images detail the three dimensional orientation of the comb and it's associated comb tines with the hair—as when used combing the hair.

DETAILED DESCRIPTION

Disclosed herein is a unique comb tine that can be incorporated in an adjacent array orientation, using multiple tines, on a hair comb. An array used in this context is described as a line, or lines, of comb tines arranged adjacently. The tines are constructed with a unique geometry that allows for the alignment of the hair along multiple axis. A hair comb equipped with the comb tines described within this disclosure has the capability to align hair along multiple axis when used in the process of combing hair. This hair comb tine—when used in an array-like configuration of multiple tines on a hair comb—has multiple advantages over existing hair comb designs. These advantages include: primary and secondary alignment of hair when a hair comb incorporating the comb tines described in this disclosure is used—resulting in a more detailed and thorough alignment of the hair. Moreover, when a hair comb equipped with multi-axis alignment tines is used in combing hair, the hair goes through a secondary alignment along the length of the comb tines, which reduces the possibility of hair binding at the base of the comb tines. This secondary alignment of hair can result in a reduction of tangling or binding of the comb/comb tines in the hair throughout the process of combing the hair. Additionally, when the comb tines of the type disclosed herein are arranged in a defined, close proximity to each other on a hair comb, the hair comb can be used to aid in the removal of unwanted debris in the hair. These are notable advantages over existing hair comb designs.

Figure 1:
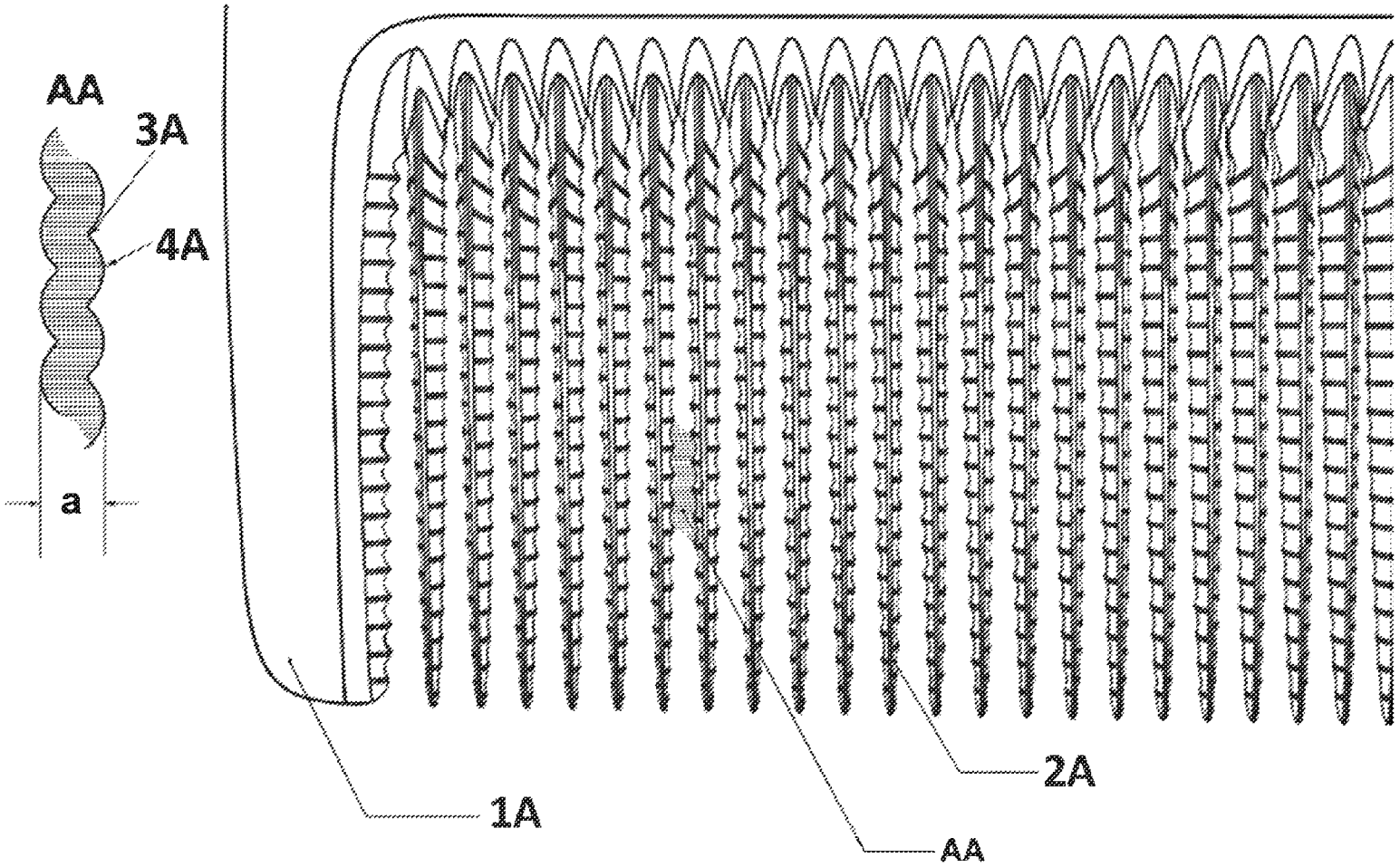
FIG. 1 is a side view of a portion of a hair comb. Comb tines are shown in detail, and the individual grooves on the tines are described—both as a single tine and as an array of adjacent tines that are oriented and spaced in a specific arrangement.

Referring to FIG. 1, a comb 1A is shown in side view, with individual tines 2A arranged in a horizontal array configuration. The comb tine geometry and spacing are shown in AA. AA shows surfaces that face each other in a convex peak 3A and concave valley 4A arrangement. AA also defines the spacing between the comb tines a. The peak 3A and valley 4A surfaces are aligned in such a way that the convex peaks 3A of one tine are horizontally opposed to the concave depressions 4A of the tine to the right or left. This offset arrangement of the convex 'peak' and concave 'valley' surfaces that face each other on opposing comb tines provides secondary alignment of the hair when the comb moves through the hair. This secondary alignment occurs along the full length of each individual tine in the tine array of the comb. The secondary alignment enabled by the comb tines allows for a more thorough alignment of the hair by a comb so equipped with comb tines of this description—resulting in a unique and novel function. The surfaces that make up the individual comb tines, as well as the tine array incorporated on a hair comb, incorporate a high level of detail to enable their function—specifically when compared to existing comb tine designs that are incorporated on hair combs. Fabrication of hair combs that incorporate multi-axis alignment tines as described herein can be accomplished in multiple ways, and can include the injection molding process of materials that include silicone, injection molded carbon fiber, polyethylene and nylon. Additional fabrication methods include 3D printing, and machining using multiple material options.

Figure 2:
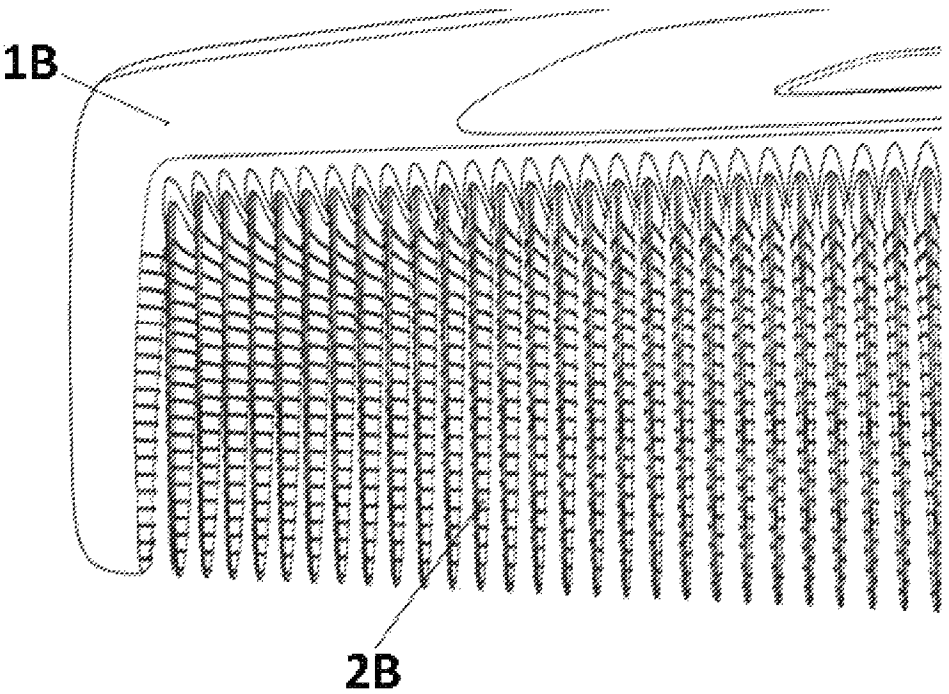
FIG. 2 is a perspective view of a portion of a hair comb. Comb tines are shown both individually (FIG. 2C) and as an array (FIG. 2A). Section details showing the geometry make-up of the tines—both individually (FIG. 2D) and as an array (FIG. 2B) of adjacent tines—are described.
Figure 2B:
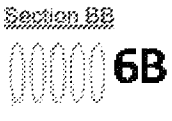
Figure 2A:
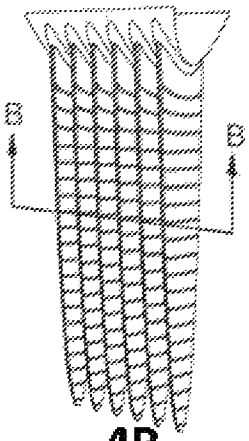
Figure 2C:
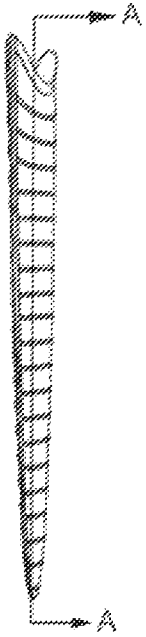
Figure 2D:
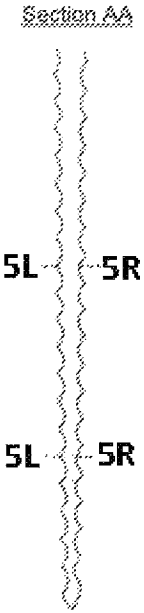

Referring to FIG. 2, a comb 1B is shown in perspective view with a tine array 2B making up the individual 'teeth' of the comb. A grouping of individual tines are shown in a tine array 4B (FIG. 2A), and a section BB is taken through the tine array and shown in detail 6B (FIG. 2B). A single comb tine is shown in perspective view 3B (FIG. 2C), with a section AA (FIG. 2D) taken through the individual tine 5B. Shown on the individual comb tine 3B is the surface detail that comprises the horizontal ridged surfaces made up of convex 'peaks' and concave 'depressions' that run the length of the comb tine (on two sides). As shown in section AA (5B), the section on the two sides that oppose each other are not symmetrical. It should also be noted that the horizontal ridged surfaces shown on the comb tines in 2B, 3B, and 4B do not completely surround the comb tine(s) but gradually diminish to zero on the front and rear edges of the comb tine(s). When the comb tines are arranged in an adjacent array format 4B, the horizontal ridged surfaces of the tines that face each other form a novel arrangement, and allow for a unique function—this being the secondary alignment of hair, when comb tines of this unique design and arrangement are used on a hair comb.

Referring to FIG. 3A, a 3D coordinate system is shown, with definition to the V (vertical) and H (horizontal) axis. FIG. 3B shows a hair comb with multi axis alignment tines of the type described herein in a typical grooming application combing hair. Primary hair alignment occurs along the drag path H of the comb, and is similar in effect to known existing comb designs. Secondary hair alignment occurs along the entire comb tine length V, and is normal (perpendicular) to the drag path of the comb. Secondary alignment of the hair along the comb tine length, enabled by the horizontal ridged surfaces of the comb tine that adjacently face each other internally along the comb tine array, is unique, novel and useful. The unique result of detailed hair alignment is possible through the use of the multi axis alignment tines on a hair comb when combing the hair.

Figure 4:
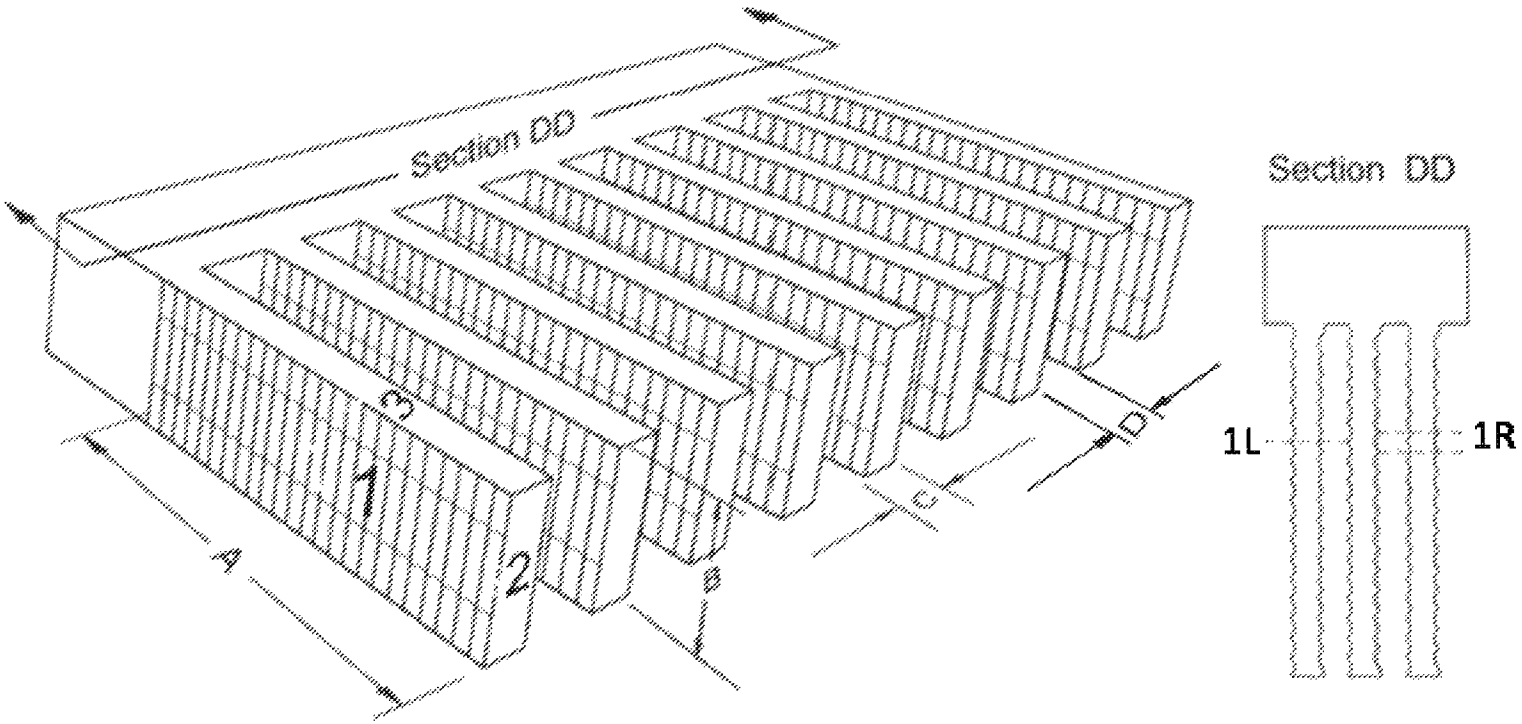
FIG. 4 is a perspective view of a simplified generic surface comb and comb tine array arrangement as described herein—along with a section view of the comb/comb tine arrangement.

Referring to FIG. 4, a simplified generic surface diagram representing a hair comb with a multi axis comb tine array is shown in perspective view. Dimensions are referenced for the individual tines of the comb, shown by A, B, C, and D—where A represents the comb tine depth, B represents the comb tine width, C represents the comb tine thickness, and D represents the spacing distance between comb tines. Primary individual comb tine surfaces are also referenced and are shown as 1, 2, and 3. Comb tine surface 1 has horizontal ridged surfaces with convex peaks and concave depressions along the entire length of the comb tine. Comb tine surfaces 2 and 3 are substantially smooth and do not have any horizontal ridges. It should be noted that the horizontal ridged surfaces found on surface 1 do not extend onto adjacent surfaces 2 and 3. It should also be noted that—as shown in section DD—that the horizontal ridged surfaces are located on both sides of the comb tine, and oppose (face) each other in an offset arrangement when set up in an array configuration. The number of horizontal ridges can vary with the geometry of the comb tine, but those skilled in the art would recognize that the number of horizontal ridges has a proportional relationship to the comb tine length and the scale of the hair comb to which the comb tine array is applied. It should also be noted that spacing D defines the proximity between the adjacent comb tines, and the spacing can be increased or decreased as desired for each unique application. Section DD further defines the horizontal ridges that make up the tine inner surfaces 1 that oppose each other internally on the comb tines that make up the comb tine array. Section DD shows the offset alignment relationship of the opposing horizontal ridges 1R, 1 L that make up the internal opposing comb tine surfaces.

Figure 5A:
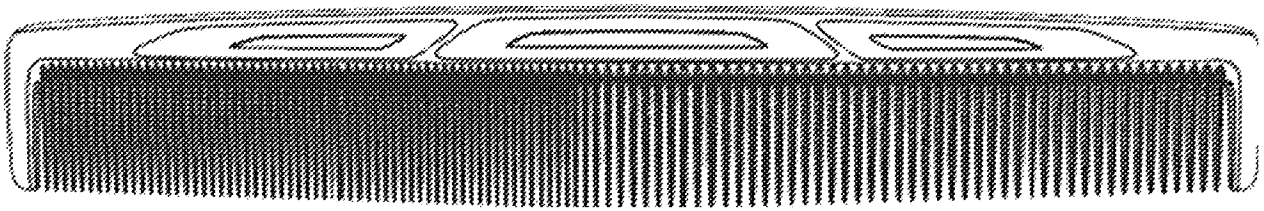
FIGS. 5A, 5B depict two different comb designs—both in side view. These comb designs contain multi axis alignment tines for a hair comb of the type described herein.
Figure 5B:
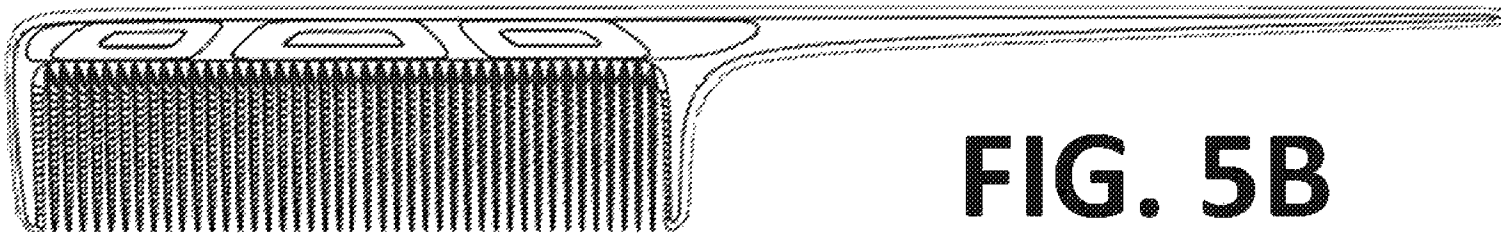

Referring to FIGS. 5A and 5B, a finite set of examples of hair combs 1C (FIG. 5A), 2C (FIG. 5B) equipped with multi-axis alignment tines is shown. Those skilled in the art would acknowledge that the multi axis alignment tines—when arranged in an adjacent array-like configuration—can be incorporated on countless hair comb designs successfully. Additionally, comb tines of the type described herein can also be incorporated on other product designs that incorporate comb tines—examples being a garden rake, mechanized farming equipment, and a lice removal comb.

Figure 6:
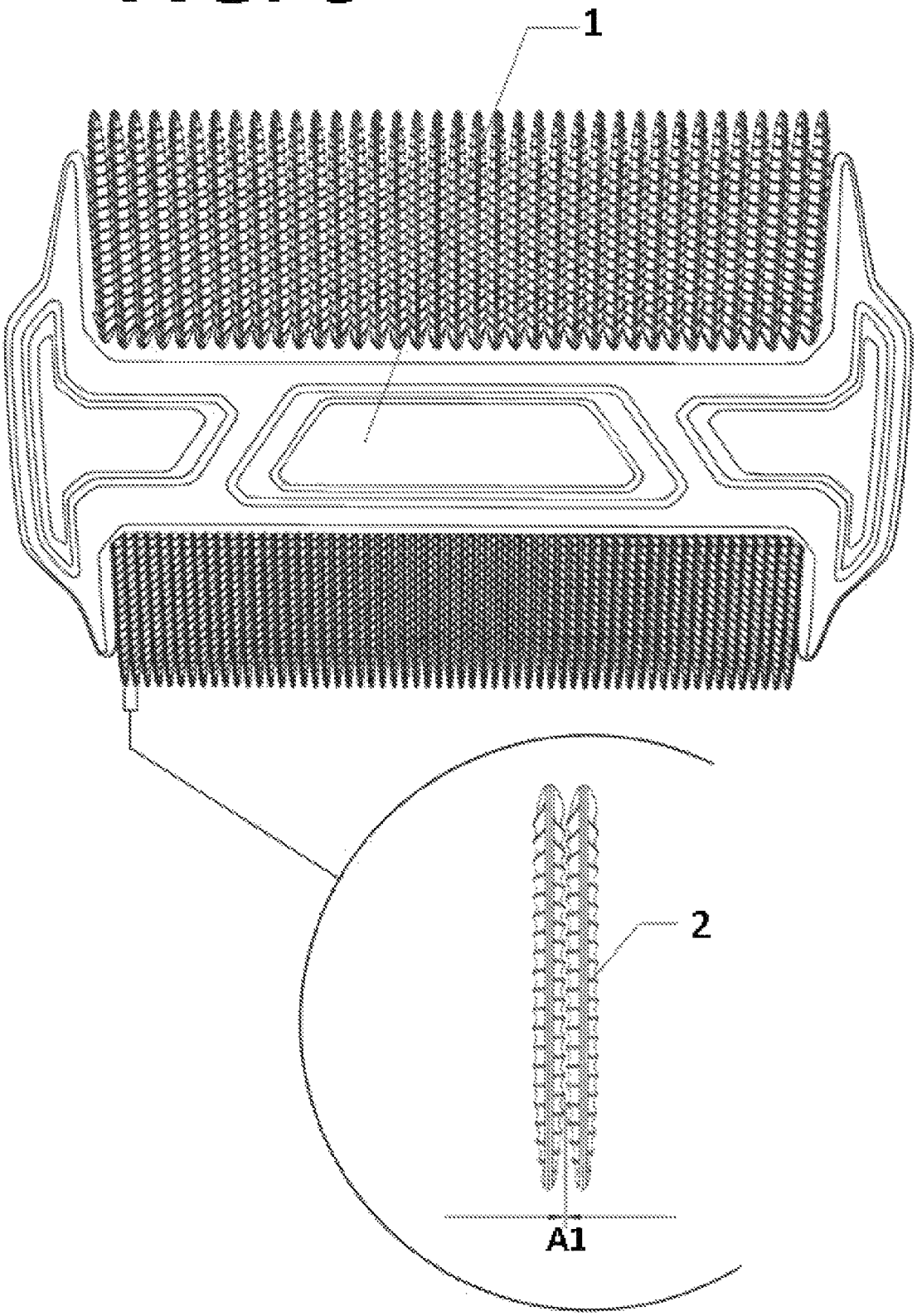
FIG. 6 details a comb design comprised of comb tines of a specific geometry and spacing that aid in the removal of unwanted debris in the hair.

Referring to FIG. 6, a comb 1 that is used in the aid of removal of unwanted debris from the hair is shown. Unwanted debris can be defined as dirt, nits or head lice and the like, which are known to commonly infiltrate the hair of both humans and animals. The comb 1 is comprised of multi axis alignment tines of the type described herein 2. Of note is the spacing A1 between the comb tines arranged in an adjacent horizontal array. To perform the function of expelling unwanted debris from the hair, the spacing between the comb tines A1 needs specific definition. Human hair strands have been documented to have a thickness in diameter range of 0.04 millimeters to 0.1 millimeters. Accordingly, the spacing between the comb tines must be of close proximity to one another in an adjacent, array configuration. Spacing A1 would typically fall in the range of 0.1 millimeters to 1.5 millimeters, when applied to a comb design used for human or animal hair. Those skilled in the art would acknowledge that applications to expel unwanted debris beyond that of human and animal hair would have corresponding dimensions for the comb tines and spacing that would be unique to that application.

Figure 7:
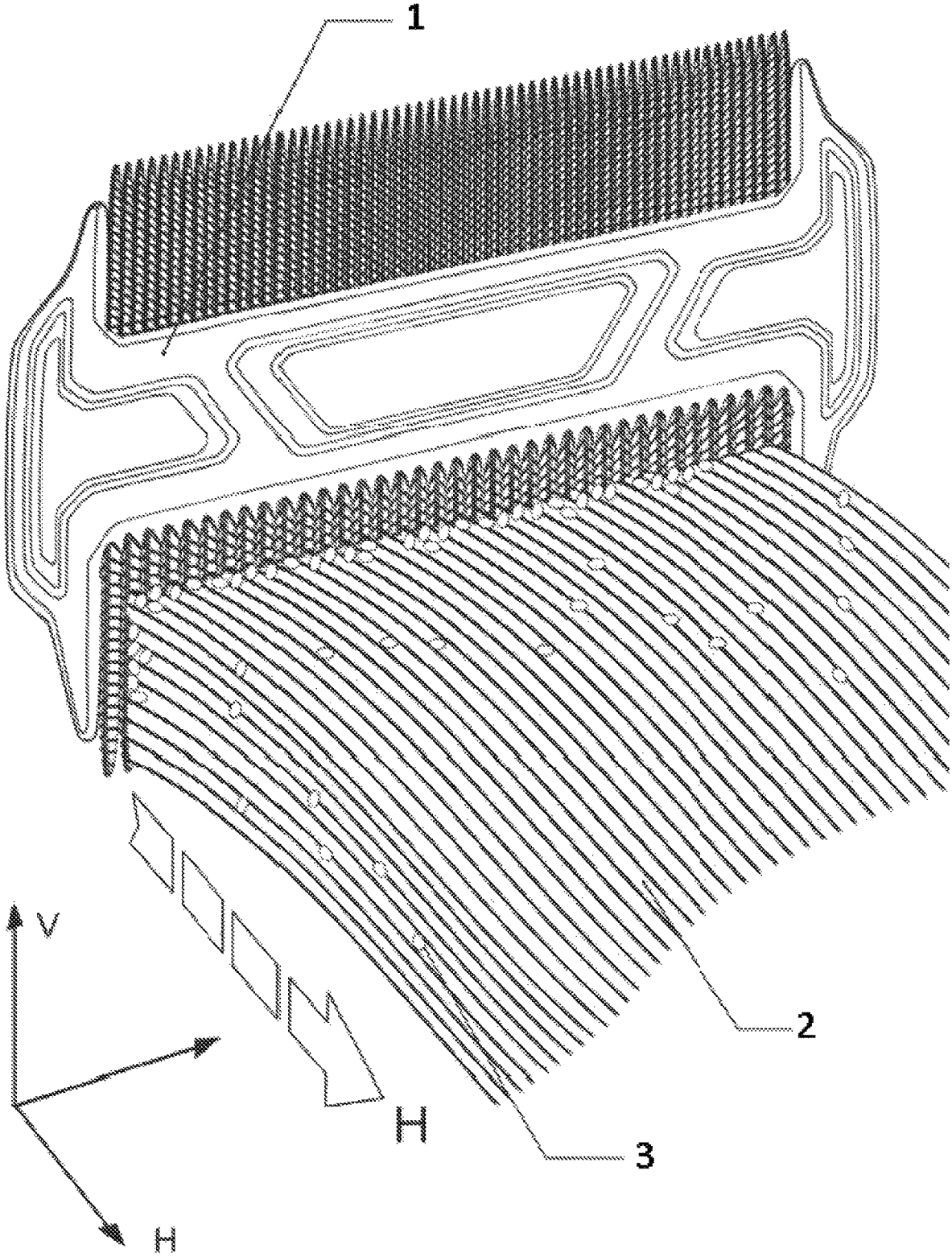
FIG. 7 is a perspective view of a comb comprised of comb tines that are oriented in a specific manner when combing hair to aid in the removal of unwanted debris residing in the hair. The image details the three dimensional orientation of the comb and it's associated comb tines with the hair—as when used combing the hair to aid in the removal of unwanted debris residing in the hair.

Referring to FIG. 7, a comb 1 that is used in the aid of removing of unwanted debris 3 from the hair 2 is shown. The comb 1 is dragged through the hair 3 along path H. As comb 1 is dragged along path H, unwanted debris 3 residing in the hair can be dislodged and accumulate at the intersection of the comb tines and hair. The spacing between the comb tines does not allow debris of a certain size to pass through the tines. Due to the unique shape and configuration of the comb tines as described herein, the unwanted debris can be collected and expelled in both the horizontal H and vertical V orientations when the comb is dragged along drag path H. This unique and novel arrangement provides advantages over existing combs that are specifically designed to rid the hair of unwanted debris.

The invention claimed is:

1. A comb for primary and secondary alignment of hair, the comb comprising:

a first plurality of tines configured to primarily align hair in a primary direction, wherein the first plurality of tines comprises:

a first tine having a first ridged profile along a first inner surface, including first peaks and first depressions; and a second tine, adjacent to the first tine, having a second ridged profile along a second inner surface, including second peaks and second depressions, wherein:

the second inner surface of the second tine faces and is opposed to the first inner surface of the first tine;

the second ridged profile of the second inner surface is offset from the first ridged profile of the first inner surface, such that the first peaks are directly opposite the second depressions;

the first tine has outer edge surfaces opposite to each other and extending straight in a singular direction along an entire length of the first tine;

the second tine has outer edge surfaces opposite to each other and extending straight in a singular direction along an entire length of the second tine; and the first plurality of tines comprises a repetitive arrangement of the first tines and the second tines.

2. The comb for primary and secondary alignment of hair of claim 1, wherein the second peaks and the second depressions of the second ridged profile are identically sized as the first peaks and the first depressions of the first ridged profile.

3. The comb for primary and secondary alignment of hair of claim 2, wherein a secondary spacing between the first peaks of the first ridged profile has a value not exceeding a range of 0.1 mm to 1.5 mm.

4. The comb for primary and secondary alignment of hair of claim 2, wherein a secondary spacing between at least a peak of the first peaks and at least a depression of the first depressions has a value not exceeding a range of 0.1 to 1.5 mm.

5. The comb for primary and secondary alignment of hair of claim 1, wherein a primary spacing between the first tine and the second tine has a value not exceeding a range of 0.1 mm and 1.5 mm.

6. The comb for primary and secondary alignment of hair of claim 1, wherein the second ridged profile of the second inner surface of the second tine and the first ridged profile of the first inner surface of the first tine are together configured to secondarily align the hair in a secondary direction.

7. The comb for primary and secondary alignment of hair of claim 6, wherein the secondary direction is orthogonal to the first primary direction.

8. The comb for primary and secondary alignment of hair of claim 1, wherein the second ridged profile of the second inner surface of the second tine and the first ridged profile of the first inner surface of the first tine are together configured to remove debris from the hair.

9. The comb for primary and secondary alignment of hair of claim 1, further comprising:

a second plurality of tines located opposite and facing away from the first plurality of tines and configured to primarily align the hair in the primary direction, wherein the second plurality of tines comprises:

a third tine having a third ridged profile along a third inner surface, including third peaks and third depressions; and a fourth tine, adjacent to the third tine, having a fourth ridged profile along a fourth inner surface, including fourth peaks and fourth depressions, wherein:

the fourth inner surface of the fourth tine faces and is opposed to the third inner surface of the third tine; and the fourth ridged profile of the fourth inner surface is offset from the third ridged profile of the third inner surface, such that the third peaks are directly opposite the fourth depressions.

10. The comb for primary and secondary alignment of hair of claim 9, having a first primary spacing between the first tine and the second tine and a second primary spacing between the third tine and the fourth tine, wherein the first primary spacing is different than the second primary spacing.

* * * * *